US005991573A

United States Patent [19]

Nohsho et al.

[11] Patent Number: 5,991,573

[45] Date of Patent: Nov. 23, 1999

[54] ELECTROPHOTOGRAPHIC PHOTOCONDUCTOR DRUM WITH WEIGHT-CONTROLLING MEMBER

[75] Inventors: Shinji Nohsho; Noboru Toriu, both of Shizuoka, Japan

[73] Assignee: Ricoh Company, Ltd., Tokyo, Japan

[21] Appl. No.: 09/137,697

[22] Filed: Aug. 21, 1998

[30] Foreign Application Priority Data

| | | | |
|---|---|---|---|
| Aug. 21, 1997 | [JP] | Japan | 9-239101 |
| Oct. 27, 1997 | [JP] | Japan | 9-309438 |
| Aug. 20, 1998 | [JP] | Japan | 10-249089 |

[51] Int. Cl.[6] ..... G03G 5/00; G03G 15/00

[52] U.S. Cl. ..... 399/159; 430/69

[58] Field of Search ..... 399/159, 167, 399/174, 350; 430/56, 69

[56] References Cited

U.S. PATENT DOCUMENTS

| | | | |
|---|---|---|---|
| 5,272,506 | 12/1993 | Goto et al. | 399/176 |
| 5,430,526 | 7/1995 | Ohkubo et al. | 399/159 |
| 5,488,459 | 1/1996 | Tsuda et al. | 399/167 |
| 5,722,016 | 2/1998 | Godlove et al. | 399/159 |

FOREIGN PATENT DOCUMENTS

| | | |
|---|---|---|
| 0 698 829 | 2/1996 | European Pat. Off. . |

*Primary Examiner*—Joan Pendegrass
*Attorney, Agent, or Firm*—Oblon, Spivak, McClelland, Maier & Neustadt, P.C.

[57] ABSTRACT

An electrophotographic photoconductor drum having a cylindrical hollow support with a length L (cm), provided that L is 30 cm or more, a photoconductive layer provided on an external surface of the cylindrical hollow support, with a total weight of the support and the photoconductive layer being W1 (g), and a weight-controlling member, with a total weight of the above-mentioned weight W1 (g) and the weight-controlling member being W2 (g), the length L, the weight W1 and the weight W2 satisfying the relationship of formula (1) of $\log(W1/L^3) \leqq -2.4$ and the formula (2) of $\log(W2/L^3) > -2.4$.

15 Claims, 2 Drawing Sheets

ELECTROPHOTOGRAPHIC PHOTOCONDUCTOR DRUM WITH WEIGHT-CONTROLLING MEMBER

BACKGROUND OF THE INVENTION

1. Field of the Invention

The present invention relates to an electrophotographic photoconductor drum comprising a cylindrical hollow support and a photoconductive layer provided thereon.

2. Discussion of Background

In line with the trend toward small-size, light-weight electrophotographic apparatus, there is an increasing demand for an electrophotographic photoconductor drum comprising a thin-walled support with a small diameter.

The photoconductor drum emits a noise due to the occurrence of resonance when a cleaning blade is brought into slide contact with the external surface of the photoconductor drum. In addition, the photoconductor drum also gives forth a noise in resonance with a contact type charger which is situated in contact with the photoconductor drum. Such problems of noise development have become an important research topic in recent years because the noise development is more frequent in the recent photoconductor drum which comprises a thin-walled cylindrical support with a small diameter.

It is known that the problem of noise resulting from the resonance triggered by the slide contact of the cleaning blade with the photoconductor drum is obvious when the photoconductor drum is continuously operated under the circumstance of high temperature and high humidity. Further, it is also known that the noise coming from the photoconductor drum in resonance with the contact-type charger varies depending on the frequency of an alternating voltage applied to the contact charger.

To minimize such noises, it is proposed to provide a member capable of absorbing or reducing the vibration on the inner surface of the photoconductor drum, as disclosed in Japanese Laid-Open Utility Model Application 62-127567. Japanese Laid-Open Patent Application 63-60481 describes that a cushioning member is pressed into a photoconductor drum for the same purpose as mentioned above. Further, it is proposed to fill a part of the hollow portion of the cylindrical support with a viscoelastic material as disclosed in Japanese Laid-Open Patent Application 3-105348.

The noise of the photoconductor drum in resonance with the contact charger is reduced bv setting the weight ratio of the photoconductor drum to the contact charger to 1.2 or more in Japanese Laid-Open Patent Application 5-35049; and by holding a material which is heavier than the total weight of the photoconductor drum in the hollow portion of the photoconductor drum via an elastic material such as an adhesive in Japanese Laid-Open Patent Application 5-35166. There is also the description that an elastic material such as a rubber in which a material such as finely-divided particles of metal is dispersed is inserted into the hollow portion of the photoconductor drum to curtail the noise by resonance between the contact charger and the photoconductor drum in Japanese Laid-Open Patent Application 5-188839. The weight ratio of the contact charger to the photoconductor drum is controlled to 1.0 or less in Japanese Laid-Open Patent Application 5-333668. As disclosed in Japanese Laid-Open Patent Application 6-19377, a member is inserted into the hollow portion of the photoconductor drum in such a fashion as illustrated in FIG. 3.

There is also the trend toward small-size, light-weight apparatus in the field of electrophotographic apparatus designed for producing images on an image receiving member with a large width of A3 size, A2 size, A1 size or A0 size. Therefore, a small-size, light-weight photoconductor drum is necessarily desired for the aforementioned electrophotographic apparatus.

In such electrophotographic apparatus corresponding to the image receiving member with a relatively large width, the abnormal sound also comes from the photoconductor drum when the cleaning blade is in slide contact with the external surface of the cylindrical photoconductor drum under the circumstances of high temperature and high humidity and when an alternating voltage is superposed to the contact type charger. The above-mentioned abnormal noises can be reduced to some extent by employing the previously mentioned conventional methods in combination or adjusting the conditions of such methods.

However, as the length of the cylindrical photoconductor drum increases, the abnormal noise is apt to be frequently produced from the photoconductor drum. Therefore, it becomes impossible to solve the occurrence of abnormal noise merely by the conventional methods.

Furthermore, when the cylindrical photoconductor drum with a relatively long length is subjected to electrophotographic process, another kind of noise comes from the photoconductor drum. To be more specific, this type of noise, which also results from the slide contact of the cleaning blade with the external surface of the photoconductor drum, is a squeal which is made at the action of starting and finishing the electrophotographic process. It is confirmed that such a squeal sound is produced when the speed of electrophotographic process, that is, the rotational speed of the photoconductor drum is changed. Namely, while the electrophotographic process is proceeding, the strange sound comes from the photoconductor drum when the process speed is within a specific speed range, generally in the range of as low as 80 mm/sec or less. The above-mentioned specific speed range relating to the noise development seems to vary depending upon the length and the weight of the photoconductor drum. The recent electrophotographic process is carried out at a high speed of 300 mm/sec or more, so that the electrophotographic process speed is inevitably within the above-mentioned low speed range at the initiation and termination of the electrophotographic process.

The above-mentioned problem of the squeal made at the initiation and termination of the electrophotographic process cannot be completely solved by any of the conventional methods.

Further, according to the previously mentioned conventional methods, the structure of a member which is inserted into the cylindrical hollow support is apt to be complicated. Furthermore, although there is required a thin-walled cylindrical support for the photoconductor drum in view of the curtailment of manufacturing cost and the decrease in weight of the drum, a member which is heavier than necessary is sometimes inserted into the photoconductor drum in practice. In addition, any conventional method for solving the problem of resonance noise cannot cope with the change of the configuration of the photoconductor drum, such as the change in length, thickness and diameter of the cylindrical support.

Further, there may be a risk of the cylindrical hollow support being deformed depending on the thickness of the cylindrical hollow support, the hardness of the weight-controlling member inserted into the hollow portion of the cylindrical support and method of fixing the weight-controlling member to the cylindrical support. In such a case, there is the problem that a half tone image cannot be exactly produced.

SUMMARY OF THE INVENTION

Accordingly, a first object of the present invention is to provide an electrophotographic photoconductor drum free from the problem of abnormal squeal sound which is made at the initiation and termination of the electrophotographic process.

A second object of the present invention is to provide an electrophotographic photoconductor drum which can be easily designed so as not to cause the conventional problem of abnormal noise development by employing an optimal weight-controlling member in light of the curtailment of manufacturing cost and the decrease in weight of the photoconductor drum.

A third object of the present invention is to provide an electrophotographic photoconductor drum comprising a thin-walled cylindrical hollow support, with the problem of abnormal noise development being eliminated without the insertion of a member into the hollow portion of the cylindrical drum in order to prevent the formation of abnormal images because of the deformation of the thin-walled cylindrical support.

A fourth object of the present invention is to provide an electrophotographic photoconductor drum which can be easily designed so as not to cause the problem of abnormal noise even though the maximum static friction coefficient of the photoconductive layer is 0.4 or more or the length of the cylindrical support is 480 mm or more.

A fifth object of the present invention is to provide a cartridge that holds the above-mentioned electrophotographic photoconductor drum and can be removed.

A sixth object of the present invention is to provide an electrophotographic apparatus comprising the above-mentioned photoconductor drum.

The above-mentioned first to fourth objects of the present invention can be achieved by an electrophotographic photoconductor drum comprising a cylindrical hollow support with a length L (cm), provided that L is 30 cm or more, a photoconductive layer provided on an external surface of the cylindrical hollow support, with a total weight of the cylindrical hollow support and the photoconductive layer being W1 (g), and a weight-controlling member, with a total weight of the weight W1 (g) and the weight-controlling member being W2 (g), the length L, the weight W1 and the weight W2 satisfying the relationship of formula (1) and formula (2):

$$\log(W1/L^3) \leqq -2.4 \quad (1)$$

$$\log(W2/L^3) > -2.4 \quad (2).$$

The fifth object of the present invention can be achieved by a cartridge that holds the above-mentioned electrophotographic photoconductor drum.

The sixth object of the present invention can be achieved by an electrophotographic apparatus comprising the above-mentioned photoconductor drum.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

For preventing the noise from the cylindrical photoconductor drum, the inventors of the present invention found the specific relationship between the length of the cylindrical support and the total weight of the support and the photoconductive layer and that between the length of the support and the total weight of the photoconductor drum including a weight-controlling member such as a flange.

In the case where the photoconductor drum comprises a cylindrical hollow support, a photoconductive layer formed thereon, and a flange attached to the support, the total weight and the manufacturing cost of the photoconductor drum can be reduced efficiently by putting a weight-controlling member into the hollow portion of the cylindrical support and fixing a weight-controlling member to the flange. The method of merely increasing the weight of the cylindrical support is not effective.

An electrophotographic photoconductor drum of the present invention comprises a cylindrical hollow support, a photoconductive layer provided on the external surface of the cylindrical support, and a weight-controlling member. In the aforementioned photoconductor drum, the relationship between the length L (cm) of the support and the total weight W1 (g) of the support and the photoconductive layer satisfies the formula (1) of $\log(W1/L^3) \leqq -2.4$, and the relationship between the length L (cm) of the support and the total weight W2 (g) of the aforementioned weight W1 and the weight-controlling member satisfies the formula (2) of $\log(W2/L^3) > -2.4$, provided that L is 30 cm or more.

The present invention will now be explained in detail by referring to FIGS. 1 through 4.

Figure 1:
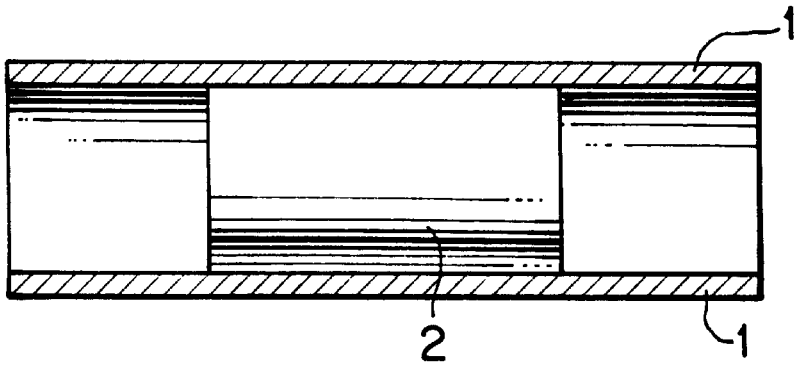
FIG. 1 is a cross-sectional view of an example of an electrophotographic photoconductor drum of the present invention comprising a cylindrical hollow support, in which a weight-controlling member is inserted.
Figure 2:
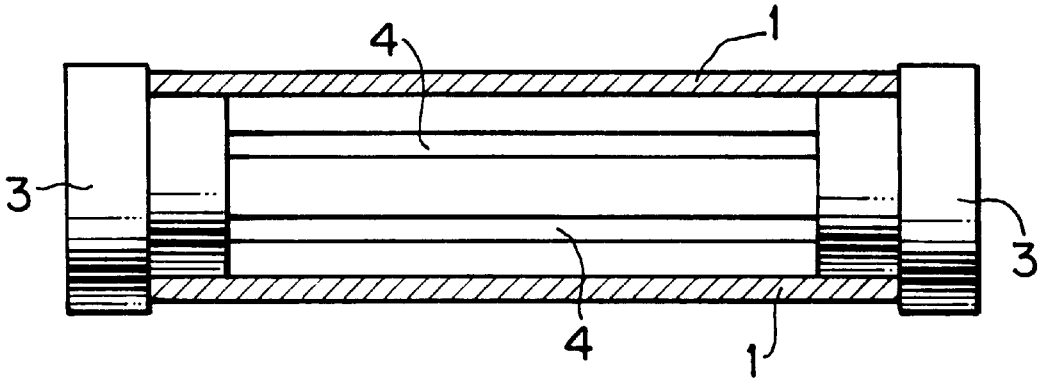
FIG. 2 is a cross-sectional view of another example of an electrophotographic photoconductor drum according to the present invention comprising a cylindrical hollow support, to which right and left flanges are attached at both ends.
Figure 3:
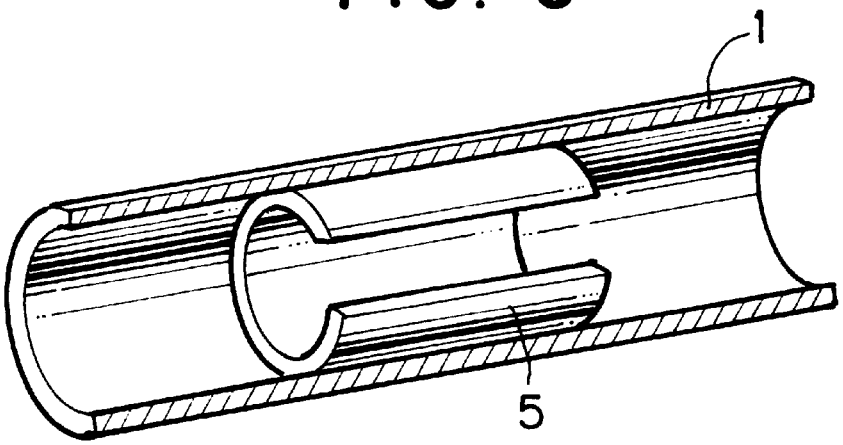
FIG. 3 is a cross-sectional view of a further example of a photoconductor drum according to the present invention comprising a cylindrical hollow support, in which a rubber plate is inserted.

FIGS. 1 to 3 are cross-sectional views which show a photoconductor drum according to the present invention. Each of the photoconductor drums shown in FIGS. 1 to 3 comprises a cylindrical hollow support 1, which is made of an electroconductive material such as a metal, for example, aluminum, nickel, copper, iron or zinc and alloys thereof.

It is preferable that the cylindrical support 1 have an outer diameter in the range of 20 to 180 mm, a length of 300 to 1,000 mm, and a thickness of 0.5 to 4 mm.

The photoconductive layer for use in the photoconductor drum is not particularly limited in the present invention, and any conventional photoconductive layers are usable.

The photoconductor drum of the present invention comprises a weight-controlling member in order to satisfy the above-mentioned relationship between the length (L) of the cylindrical support and the total weight (W2) of the photoconductor drum.

For instance, as shown in FIG. 1, a weight-controlling member 2 may be inserted into the hollow portion of the cylindrical support 1. In this case, a metal and a rubber are preferably used as the constituent materials of the weight-controlling member 2.

In the photoconductor drum illustrated in FIG. 2, flanges 3 are attached to both ends of a cylindrical support 1. The flanges 3, shafts 4 for connecting the right and left flanges 3 and screws (not shown in FIG. 2) serve as the weight-controlling members in this embodiment. In addition, any flanges are usable in the present invention.

In FIG. 3, a rubber plate 5 serving as the weight-controlling member is inserted into the hollow portion of a cylindrical support 1. In this case, ethylene propylene rubber is preferably used for the rubber plate 5 because the manufacturing cost can be reduced, the stability of the weight-controlling member can be ensured and there is no odor.

Figure 4:
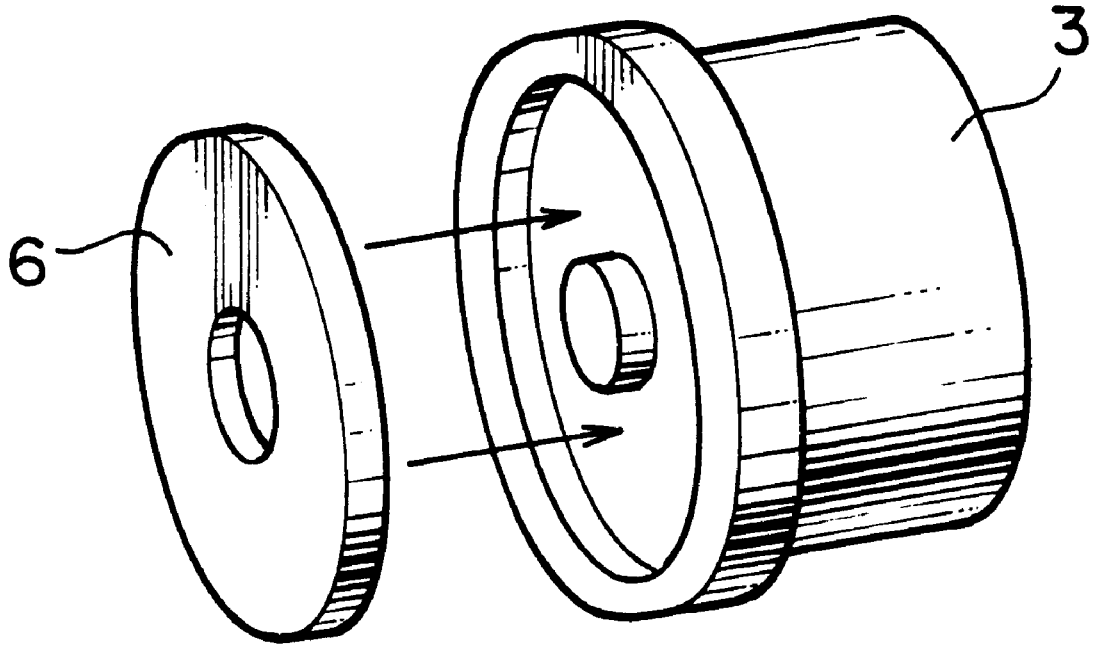
FIG. 4 is a schematic view of a flange to which a metal plate is fixed.

Furthermore, when the flanges are attached to the cylindrical support, a weight-controlling member, such as a metal plate 6, may be fixed to a flange 3, as shown in FIG. 4. In this case, an iron plate subjected to rust prevention treatment may be used as the metal plate 6 in terms of the manufacturing cost, the stability, and the reliability.

The metal plate 6 can be fixed to the flange 3 with an adhesive such as an epoxy resin. Alternatively, the metal plate 6 may be fastened to the flange 3 with a screw when the increase of the total weight (W2) of the photoconductor drum is required.

The total weight (W2) of the photoconductor drum can be increased not only by attaching the weight-controlling member, such as the metal plate and the screws, to the flange, but also by increasing the weight of the flange itself. To be more specific, a portion of the flange which is inserted into the cylindrical support may be extended, or a material with a large specific gravity may be used for the flange.

When the weight of the weight-controlling member inserted into the cylindrical support and/or the weights of the flange and the weight-controlling member attached thereto are increased, the previously mentioned formula (2) can be satisfied more easily. However, in view of the lightening of the electrophotographic apparatus, it is preferable to reduce the weight of the weight-controlling member so long as the formulas (1) and (2) are satisfied.

With respect to the length of the cylindrical support, a support with a length of 300 to 1,000 mm is applicable to the present invention. Although the problem of noise development due to resonance is particularly serious when the length of the cylindrical support for use in the conventional photoconductor drum is 480 mm or more, this problem can be effectively solved by the present invention.

Moreover, when the maximum static friction coefficient of the photoconductive layer for use in the conventional photoconductor drum exceeds 0.4, the abnormal noise is frequently produced. This problem can be minimized by the present invention even though the maximum static friction coefficient of the photoconductive layer is 0.4 or more. In the present invention, the maximum static friction coefficient is measured in accordance with the method described in Japanese Laid-Open Patent Application 9-166919.

Other features of this invention will become apparent in the course of the following description of exemplary embodiments, which are given for illustration of the invention and are not intended to be limiting thereof.

EXAMPLE 1

[Fabrication of Photoconductor Drum No. 1]

(Formation of charge generation layer)

10.0 parts by weight of a charge generation material represented by the following formula (a), 2.5 parts by weight of a commercially available polyvinyl butyral resin (Trademark "XYHL", made by Union Carbide Japan K.K.), and 360 parts by weight of tetrahydrofuran were kneaded and dispersed in a ball mill for 72 hours.

(a)

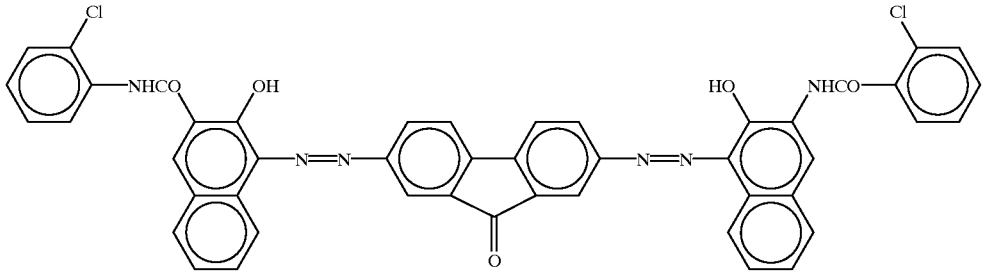

To the above prepared mixture, 211 parts by weight of tetrahydrofuran and 356 parts by weight of ethylene glycol monoethyl ether were added, and the mixture thus obtained was kneaded and dispersed for one hour. This mixture was diluted with 376 parts by weight of tetrahydrofuran and 664 parts by weight of ethylene glycol monoethyl ether, so that a coating liquid for a charge generation layer was prepared.

The thus prepared charge generation layer coating liquid was coated on the external surface of a cylindrical hollow electroconductive support with a diameter of 60 mm, a length of 660 mm and a thickness of 3 mm by spray coating. Thus, a charge generation layer with a thickness of 0.1 $\mu$m was provided on the external surface of the electroconductive support.

(Formation of charge transport layer)

70 parts by weight of a charge transport material represented by the following formula (b) and 100 parts by weight of 4,4'-dihydroxyphenyl-1,1-cyclohexylidene polycarbonate of formula (c) serving as a binder resin were dissolved in a mixed solvent of 900 parts by weight of tetrahydrofuran and 1674 parts by weight of cyclohexanone. To the above prepared solution, 0.2 parts by weight of a 1% tetrahydrofuran solution of a commercially available silicone oil (Trademark "KF-50", made by Shin-Etsu Chemical Co., Ltd.) were added, so that a coating liquid for a charge transport layer was prepared.

(b)

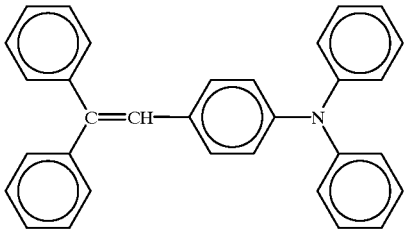

(c)

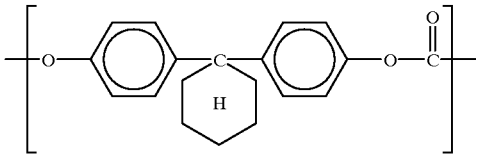

The thus prepared charge transport layer coating liquid was coated on the charge generation layer, whereby a charge transport layer with a thickness of 20 $\mu$m was provided on the charge generation layer.

The total weight (W1) of the photoconductive layer (consisting of the charge generation layer and the charge transport layer) and the cylindrical hollow support was 1,010 g.

Two resin flanges with a total weight of 34 g were attached to both ends of the above prepared photoconductor drum No. 1 by press fitting. An iron plate weighing 120 g, which was subjected to rust prevention treatment was fixed to one of the flanges.

Thus, a photoconductor drum No. 1 according to the present invention was fabricated.

After completion of the assembling, the total weight (W2) of the photoconductor drum was 1,164 g.

EXAMPLES 2 TO 9 AND COMPARATIVE EXAMPLES 1 TO 7

The procedure for fabrication of the photoconductor drum No. 1 in Example 1 was repeated except that the size of the cylindrical hollow electroconductive support was changed in each Example as indicated in TABLE 1.

Further, in Example 5 and Comparative Example 7, the amount of the 1% tetrahydrofuran solution of silicone oil (Trademark "KF-50", made by Shin-Etsu Chemical Co., Ltd.) for use in the charge transport layer coating liquid was changed from 0.2 to 2 parts by weight in order to reduce the maximum static friction coefficient of the obtained photoconductive layer.

The total weight (W1) of the cylindrical support and the photoconductive layer was measured. The results are shown in TABLE 1.

Furthermore, in each photoconductor drum, flanges and other weight-controlling members such as a member inserted into the cylindrical support as shown in FIG. 1 or 3, and an attachment fixed to the flange as shown in FIG. 4 were set as indicated in TABLE 2.

Then, the total weight (W2) including the weight (W1) and the weight-controlling member was measured.

The results are also shown in TABLE 2.

Further, the maximum static friction coefficient was measured and the values of $\log(W1/L^3)$ and $\log(W2/L^3)$ were calculated.

The results are shown in TABLE 3.

Each of the photoconductor drums obtained in Examples 1 to 9 and Comparative Examples 1 to 7 was incorporated into an electrophotographic apparatus equipped with a cleaning blade, a contact type charger and a developer unit. The electrophotographic process was repeated under the circumstances of high temperature. The occurrence of abnormal noise from the photoconductor drum due to the resonance was examined in the course of continuous electrophotographic process, with the temperature of the photoconductor drum being maintained at 45° C. Further, the sound of squeal made at the action of starting and finishing the electrophotographic process was also checked.

The results are shown in TABLE 3.

EXAMPLE 10

[Fabrication of Photoconductor Drum No. 10]

(Formation of undercoat layer)

The following components were mixed to prepare a coating liquid for an undercoat layer.

| | Parts by Weight |
|---|---|
| Polyamide resin | 10 |
| Titanium oxide | 40 |
| 1-butanol | 20 |
| Methyl alcohol | 180 |

The thus prepared undercoat layer coating liquid was coated on the external surface of a cylindrical hollow aluminum support with a diameter of 30 mm and a length of 340 mm by dip coating, and dried, so that an undercoat layer with a thickness of 3.0 $\mu$m was provided on the cylindrical aluminum support.

(Formation of charge generation layer)

The following components were mixed to prepare a coating liquid for a charge generation layer.

| | Parts by Weight |
|---|---|
| Titanyl phthalocyanine | 3 |
| Polyvinyl butyral resin | 1 |
| Cyclohexanone | 250 |
| Cyclohexane | 50 |

The thus prepared charge generation layer coating liquid was coated on the above prepared undercoat layer by dip coating, and dried, so that a charge generation layer with a thickness of 0.2 $\mu$m was provided on the undercoat layer.

(Formation of charge transport layer)

The following components were mixed to prepare a coating liquid for a charge transport layer.

| | Parts by Weight |
|---|---|
| Polycarbonate resin | 10 |
| Silicone oil | 0.02 |
| Methylene chloride | 80 |
| Charge transport material of formula (d): | 7 |

-continued

| Parts by Weight |
|---|
| 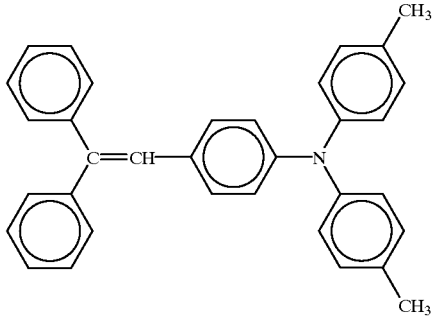 |

The thus prepared charge transport layer coating liquid was coated on the above prepared charge generation layer by dip coating, and dried, so that a charge transport layer with a thickness of 30 μm was provided on the charge generation layer.

The total weight (W1) of the photoconductive layer (consisting of the undercoat layer, the charge generation layer and the charge transport layer) and the cylindrical hollow support was 68 g.

Two flanges, of which material was the same resin as employed in Example 3, but of which volume was about 7 times that of the flanges employed in Example 3, were attached to both ends of the above prepared photoconductor drum by press fitting. The total weight of the flanges were 110 g.

Thus, a photoconductor drum No. 10 according to the present invention was fabricated.

After completion of the assembling, the total weight (W2) of the photoconductor drum was 178 g.

The photoconductor drum No. 10 was incorporated into the same electrophotographic apparatus as employed in Example 1, and the electrophotographic process was repeated under the circumstances of high temperature. The occurrence of abnormal noise from the photoconductor drum due to the resonance was examined in the course of continuous electrophotographic process, with the temperature of the photoconductor drum being maintained at 45° C. Further, the sound of squeal made at the action of starting and finishing the electrophotographic process was also checked.

The results are shown in TABLE 3.

EXAMPLE 11

The procedure for fabrication of the photoconductor drum No. 10 in Example 10 was repeated except that the resin flanges employed in Example 10 were replaced by aluminum flanges prepared by die casting.

Thus, a photoconductor drum No. 11 according to the present invention was obtained.

After completion of the assembling, the total weight (W2) of the photoconductor drum was 228 g.

The photoconductor drum No. 11 was incorporated into the same electrophotographic apparatus as employed in Example 1, and the electrophotographic process was repeated under the circumstances of high temperature. The occurrence of abnormal noise from the photoconductor drum due to the resonance was examined in the course of continuous electrophotographic process, with the temperature of the photoconductor drum being maintained at 45° C. Further, the sound of squeal made at the action of starting and finishing the electrophotographic process was also checked.

The results are shown in TABLE 3.

TABLE 1

| | Cylindrical Hollow Support | | | Total Weight |
|---|---|---|---|---|
| | Diameter (mm) | Length (mm) | Thickness (mm) | [W1] (g) |
| Ex. 1 | 60 | 660 | 3.0 | 1010 |
| Ex. 2 | 100 | 540 | 1.2 | 510 |
| Ex. 3 | 30 | 340 | 0.75 | 66 |
| Ex. 4 | 80 | 970 | 3.0 | 2004 |
| Ex. 5 | 60 | 660 | 3.0 | 1010 |
| Ex. 6 | 30 | 340 | 0.75 | 66 |
| Ex. 7 | 30 | 340 | 0.75 | 66 |
| Ex. 8 | 60 | 660 | 3.0 | 1010 |
| Ex. 9 | 100 | 540 | 1.2 | 510 |
| Comp. Ex. 1 | 60 | 660 | 3.0 | 1010 |
| Comp. Ex. 2 | 100 | 540 | 1.2 | 510 |
| Comp. Ex. 3 | 30 | 340 | 0.75 | 66 |
| Comp. Ex. 4 | 80 | 970 | 3.0 | 2004 |
| Comp. Ex. 5 | 30 | 340 | 0.75 | 66 |
| Comp. Ex. 6 | 60 | 660 | 3.0 | 1010 |
| Comp. Ex. 7 | 100 | 540 | 1.2 | 510 |
| Ex. 10 | 30 | 340 | 0.75 | 68 |
| Ex. 11 | 30 | 340 | 0.75 | 68 |

TABLE 2

| | Weight-controlling Member | | | | | |
|---|---|---|---|---|---|---|
| | Flange | | Other weight-controlling member | | | Total Weight |
| | Type | Weight (g) | Mode | Material | Weight (g) | [W2] (g) |
| Ex. 1 | Press-fitted resin type | 34 | FIG. 4 | Iron plate | 120 | 1164 |
| Ex. 2 | Same as above | 108 | FIG. 3 | Ethylene propylene rubber plate | 200 | 818 |
| Ex. 3 | Same as above | 15 | FIG. 1 | Aluminum | 200 | 281 |
| Ex. 4 | Nil | 0 | FIG. 1 | Aluminum | 2000 | 4004 |
| Ex. 5 | Press-fitted resin type | 34 | FIG. 4 | Iron plate | 120 | 1164 |
| Ex. 6 | Same as above | 15 | FIG. 1 | Aluminum | 100 | 181 |
| Ex. 7 | Same as above | 15 | FIG. 1 | Aluminum | 150 | 231 |
| Ex. 8 | Same as above | 34 | FIG. 4 | Iron plate | 200 | 1244 |
| Ex. 9 | Same as above | 108 | FIG. 3 | Natural rubber plate | 200 | 818 |
| Comp. Ex. 1 | Same as above | 34 | Nil | — | 0 | 1044 |
| Comp. Ex. 2 | Same as above | 108 | Nil | — | 0 | 618 |

TABLE 2-continued

| | Weight-controlling Member | | | | | |
|---|---|---|---|---|---|---|
| | Flange | | Other weight-controlling member | | | Total Weight |
| | Type | Weight (g) | Mode | Material | Weight (g) | [W2] (g) |
| Comp. Ex. 3 | Same as above | 15 | Nil | — | 0 | 81 |
| Comp. Ex. 4 | Nil | 0 | Nil | — | 0 | 2004 |
| Comp. Ex. 5 | Press-fitted resin type | 15 | FIG. 1 | Aluminum | 50 | 131 |
| Comp. Ex. 6 | Same as above | 34 | FIG. 4 | Iron plate | 60 | 1104 |
| Comp. Ex. 7 | Same as above | 108 | Nil | — | 0 | 618 |
| Ex. 10 | Same as above | 110 | Nil | — | 0 | 178 |
| Ex. 11 | Aluminum type by die casting | 160 | Nil | — | 0 | 228 |

TABLE 3

| | Maximum Static Friction Coefficient | $\log(W1/L^3)$ [$\log(g/cm^3)$] | $\log(W2/L^3)$ [$\log(g/cm^3)$] | Noise Development |
|---|---|---|---|---|
| Ex. 1 | 0.45 | −2.45 | −2.39 | Absent |
| Ex. 2 | 0.45 | −2.49 | −2.28 | Absent |
| Ex. 3 | 0.45 | −2.77 | −2.15 | Absent |
| Ex. 4 | 0.45 | −2.66 | −2.36 | Absent |
| Ex. 5 | 0.25 | −2.45 | −2.39 | Absent |
| Ex. 6 | 0.45 | −2.77 | −2.34 | Absent |
| Ex. 7 | 0.45 | −2.77 | −2.23 | Absent |
| Ex. 8 | 0.45 | −2.45 | −2.36 | Absent |
| Ex. 9 | 0.45 | −2.49 | −2.28 | Absent |
| Comp. Ex. 1 | 0.45 | −2.45 | −2.44 | Obvious noise |
| Comp. Ex. 2 | 0.45 | −2.49 | −2.41 | Faint noise |
| Comp. Ex. 3 | 0.45 | −2.77 | −2.69 | Obvious noise |
| Comp. Ex. 4 | 0.45 | −2.66 | −2.66 | Obvious noise |
| Comp. Ex. 5 | 0.45 | −2.77 | −2.48 | Obvious noise |
| Comp. Ex. 6 | 0.45 | −2.45 | −2.42 | Faint noise |
| Comp. Ex. 7 | 0.25 | −2.49 | −2.41 | Faint noise |
| Ex. 10 | 0.43 | −2.76 | −2.34 | Absent |
| Ex. 11 | 0.43 | −2.76 | −2.34 | Absent |

As can be seen from the results shown in Tables 1 to 3, when the relationship between the total weight (W1) of the cylindrical hollow support and the photoconductive layer and the length (L) of the cylindrical support did not satisfy the formula of $\log(W1/L^3) \leqq -2.4$, and the total weight (W2) of the photoconductor drum including a weight-controlling member such as a flange did not satisfy the formula of $\log(W2/L^3) > -2.4$, abnormal noise occurred from the photoconductor drum because of the resonance.

In contrast to this, there was no abnormal noise in the photoconductor drum according to the present invention because the above-mentioned conditions were satisfied by adjusting the total weight of the photoconductor drum.

In general, the conventional photoconductor drum of which cylindrical support has a length of 480 mm or more, or of which photoconductive layer shows a maximum static friction coefficient of 0.40 or more cannot prevent the occurrence of abnormal noise resulting from the resonance. However, according to the present invention, even though the length of the cylindrical support is 480 mm or more, or the maximum static friction coefficient of the photoconductive layer exceeds 0.40, the abnormal noise can be effectively eliminated.

Furthermore, the photoconductor drums No. 1 and No. 2 according to the present invention obtained in Examples 1 and 2 were subjected to copying test in such a manner that 300,000 copies were continuously made under the circumstances of high temperature. No abnormal noise occurred from each photoconductor drum No. 1 or 2 in the course of the copying test, and in addition, there was no problem of rust and unfavorable odor.

With respect to the photoconductor drums No. 10 and No. 11 according to the present invention obtained in Examples 10 and 11, the total weight (W2) of each photoconductor drum was controlled merely by adjusting the weight of the flanges attached to both ends of the cylindrical support. Therefore, since no material was inserted into the hollow portion of the cylindrical support and no attachment was fixed to the flanges with an adhesive, there was no risk of the cylindrical support being deformed in the course of electrophotographic process.

As previously explained, abnormal sound of squeal which occurs from the photoconductor drum at the initiation and termination of the electrophotographic process can be prevented by the present invention.

When the electrophotographic apparatus is designed, it is possible to theoretically design the photoconductor drum without producing any abnormal noise by taking the previously mentioned formulas (1) and (2) of the photoconductor drum into consideration.

Further, it is possible to prevent excessive increase of the weight of the weight-controlling member when the previously mentioned formulas (1) and (2) of the photoconductor drum are taken into consideration. Therefore, the weight-controlling member in an optimum weight can be employed, so that the manufacturing cost can be reduced and the lightening of the electrophotographic apparatus can be achieved. In addition, even though the photoconductor drum employs a thin-walled cylindrical support, it is possible to inhibit the development of abnormal noise without inserting a weight-controlling member into the hollow portion of the thin-walled cylindrical support. Accordingly, the cylindrical support is not deformed, so that any abnormal images caused by the deformation of the cylindrical support are never produced.

Moreover, even though the maximum static friction coefficient of the photoconductor is 0.4 or more or the length of the cylindrical support is 480 mm or more, the problem of noise development can be solved.

Thus, the specific method of controlling the total weight of the photoconductor drum and a constituent material of the weight-controlling member can be easily selected so as to satisfy the previously mentioned formulas (1) and (2).

Japanese Patent Application No. 09-239101 filed Aug. 21, 1997, Japanese Patent Application No. 09-309438 filed Oct. 27, 1997, and Japanese Patent Application filed Aug. 20, 1998 are hereby incorporated by reference.

What is claimed is:

1. An electrophotographic photoconductor drum comprising:

a cylindrical hollow support with a length L (cm), provided that L is 30 cm or more, a photoconductive layer provided on an external surface of said cylindrical hollow support, with a total weight of said cylindrical hollow support and said photoconductive layer being W1 (g), and a weight-controlling member, with a total weight of said weight W1 (g) and said weight-controlling member being W2 (g), said length L, said weight W1 and said weight W2 satisfying the relationship of formula (1) and formula (2):

$$\log(W1/L^3) \leqq -2.4 \quad (1)$$

$$\log(W2/L^3) > -2.4. \quad (2)$$

2. The photoconductor drum as claimed in claim 1, wherein said weight-controlling member comprises a flange attached to said cylindrical support.

3. The photoconductor drum as claimed in claim 1, wherein said weight-controlling member is inserted into a hollow portion of said cylindrical hollow support.

4. The photoconductor drum as claimed in claim 1, wherein said weight-controlling member comprises a flange attached to said cylindrical support and a member which is inserted into a hollow portion of said cylindrical hollow support.

5. The photoconductor drum as claimed in claim 2, wherein said weight-controlling member further comprises an attachment fixed to said flange.

6. The photoconductor drum as claimed in claim 1, wherein said cylindrical hollow support has a thickness of 1.5 mm or less.

7. The photoconductor drum as claimed in claim 2, wherein said cylindrical hollow support has a thickness of 1.5 mm or less.

8. The photoconductor drum as claimed in claim 5, wherein said cylindrical hollow support has a thickness of 1.5 mm or less.

9. The photoconductor drum as claimed in claim 1, wherein a maximum static friction coefficient of said photoconductive layer is 0.4 or more.

10. The photoconductor drum as claimed in claim 1, wherein said length of said cylindrical hollow support is 480 mm or more.

11. The photoconductor drum as claimed in claim 3, wherein said member is made of an ethylene-propylene rubber.

12. The photoconductor drum as claimed in claim 4, wherein said member is made of an ethylene-propylene rubber.

13. The photoconductor drum as claimed in claim 5, wherein a constituent material of said attachment to said flange is iron which is subjected to rust prevention treatment.

14. A cartridge of an electrophotographic photoconductor drum comprising:

a cylindrical hollow support with a length L (cm), provided that L is 30 cm or more, a photoconductive layer provided on an external surface of said cylindrical hollow support, with a total weight of said cylindrical hollow support and said photoconductive layer being W1 (g), and a weight-controlling member, with a total weight of said weight W1 (g) and said weight-controlling member being W2 (g), said length L, said weight W1 and said weight W2 satisfying the relationship of formula (1) and formula (2):

$$\log(W1/L^3) \leqq -2.4 \quad (1)$$

$$\log(W2/L^3) > -2.4. \quad (2)$$

15. An electrophotographic photoconductor apparatus comprising an electrophotographic photoconductor drum comprising:

a cylindrical hollow support with a length L (cm), provided that L is 30 cm or more, a photoconductive layer provided on an external surface of said cylindrical hollow support, with a total weight of said cylindrical hollow support and said photoconductive layer being W1 (g), and a weight-controlling member, with a total weight of said weight W1 (g) and said weight-controlling member being W2 (g), said length L, said weight W1 and said weight W2 satisfying the relationship of formula (1) and formula 2):

$$\log(W1/L^3) \leqq -2.4 \quad (1)$$

$$\log(W2/L^3) > -2.4. \quad (2)$$

* * * * *